United States Patent [19]

Didier et al.

[11] 4,082,541

[45] Apr. 4, 1978

[54] INSTALLATION FOR THE AGGLOMERATION OF A PARTICULATE MINERAL CHARGE AND OPERATION THEREOF

[75] Inventors: Alain Didier; Jean-Luc Letailleur, both of Metz, France

[73] Assignee: Institut de Recherches de la Siderurgie Francaise (IRSID), St. Germain-en-Laye, France

[21] Appl. No.: 559,140

[22] Filed: Mar. 17, 1975

[30] Foreign Application Priority Data

Mar. 27, 1974 France ..... 74 10588

[51] Int. Cl.[2] ..... C22B 1/08; C22B 1/24; C22B 1/16

[52] U.S. Cl. ..... 75/5; 75/3; 75/4

[58] Field of Search ..... 75/3–5

[56] References Cited

U.S. PATENT DOCUMENTS 3,816,096 6/1974 Tsujihata ..... 75/5

*Primary Examiner*—P. D. Rosenberg
*Attorney, Agent, or Firm*—Kurt Kelman

[57] ABSTRACT

In a method of operating an installation for the agglomeration of a particulate charge of a mineral and combustible material mixture supported on an elongate grid, moving through a treatment path, the position of the point of firing of the charge is determined, this position corresponding to the contact of the local combustion zone of the mixture with the grid and the velocity of displacement of the moving grid being modified to maintain this point of firing at a predetermined position in respect of the path. The installation comprises sampling means for determining the instant at which the temperature of the gas passed through the charge rises, calculating means generating a signal representative of the position of the point of firing, and a comparator unit generating a correction signal for modifying the velocity by comparing the correction signal with a reference signal. This improves the regularity of the firing of minerals to be agglomerated.

4 Claims, 5 Drawing Figures

INSTALLATION FOR THE AGGLOMERATION OF A PARTICULATE MINERAL CHARGE AND OPERATION THEREOF

The present invention relates to improvement in the operation of an installation for the agglomeration of a particulate mineral charge, such as iron mineral, on a moving elongate grid, wherein the charge is subjected to a firing or sintering treatment.

In conventional agglomeration or sintering operations, a humidified mixture of a particulate mineral and of a solid combustible material forming a charge to be agglomerated is placed at one end of an endless moving grid. The charge disposed on the grid is first superficially ignited by means of suitable burners, and a gas is then passed through the charge during agglomeration along the grid so that combustion develops in a thin layer which progressively approaches the grid. The place where the thin layer of combustion reaches the grid is considered in the art as the point of firing of the charge, as this expression is used throughout the specification and claims.

The satisfactory operation of the agglomeration process requires that the point of firing of the charge be maintained as precisely as possible at a predetermined position of the path. In fact, if this point of firing were too close to the output end of the grid where the agglomerated or sintered charge is discharged from the grid, the discharged product contains an amount of combustible material not burned and an amount of the mixture which is not fired. Such a product is of poor quality. On the other hand, if the point of firing were too far from the output end of the grid, the capacity of the installation would be poorly utilized. Furthermore, the permeability of a fired charge is much higher than that of a charge in the process of being fired so that the aspiration of the gas in the upstream portions of the grid would be reduced if the firing point were situated too far from the downstream end of the grid. This produces phenomena of instability incompatible with a production of standard quality.

It is accordingly desirable to maintain the position of the point of firing of the charge on the grid at a predetermined point, most frequently in the neighborhood of the discharge end of the grid. Various methods have been proposed to achieve this result, such as to modify the velocity of displacement of the mobile grid in response to the distribution of the temperatures recorded in the successive gas aspiration boxes disposed under the grid to pass the gas through the charge. It has actually been found that the temperature of the gas under the grid supporting the charge remains substantially constant during the greatest part of the firing process, then rises until it attains a maximum, and finally decreases towards the downstream end of the grid. This temperature development is explained by the fact that the gas temperature remains practically constant as long as a layer of humidity remains in contact with the grid, rises when this layer has been dried out until it reaches a maximum value at which, at least theoretically, the point of firing reaches the grid, and finally decreases because of the lack of combustible material. It is possible to draw a diagram of the recorded temperature values as a function of the position of the respective points of temperature measurement, this diagram constituting a temperature curve whose initial portion is substantially rectilinear and whose final portion comprises successive parts of a curve of positive inclination, a maximum and a curve of negative inclination. In principle, the position of this maximum may thus be determined and the velocity of the displacement of the grid may be so controlled that this maximum is maintained at a predetermined position of the grid. In effect, an increase in the grid speed tends to move the point of firing closer to the downstream end of the grid, all other operating conditions being equal, while a reduction in the grid speed produces the opposite result. However, for the following reasons, such a control of the operation of an agglomeration installation does not produce satisfactory results:

(1) The temperatures recorded along the grid correspond to different elements of the charge so that the course of the temperature curve is deformed by uncontrolled parameters, such as the composition and permeability of the charge. This distortion of the temperature curve is the more certain the less constant the characteristics of the charge are held but they cannot be completely suppressed under any circumstances. Thus, the grid speed may be modified on the basis of a temperature reading which corresponds only to a phenomenon apparently reflective of a displacement of the point of firing.

(2) The curvature of the curve of the recorded temperatures is very small in the region of the maximum, in view of the thermal inertia of the grid. Therefore, it is very difficult to localize the maximum on the curve, even if the number of temperature measuring points is considerable. In addition, the previously mentioned disadvantage leads to variations in the position of the maximum which increase in proportion to the weakness of the curvature of the temperature curve in this region, these variations not being representative of a real phenomenon because of the above-mentioned distortions in the curve.

Thus, the position of the maximum of the temperature curve and the actual position of the point of firing generally do not coincide and variations in the former position are not necessarily representative of variations in the latter position. Thus, the traced maximum of the temperature curves cannot be used directly as an accurate control criterion for the operation of an agglomeration installation.

It is the primary object of this invention to overcome the indicated disadvantages and, more particularly, to permit control of the operation of an agglomeration operation on a mobile grid on the basis of indication of temperatures recorded during the firing treatment of the charge.

The invention accomplishes the above and other objects in a method of operating an installation for the agglomeration of a particulate mineral on a elongate grid moving through a treatment path, wherein a gas is passed through the charge during agglomeration, the temperature of the gas passed through the charges is measured along the path, and the velocity of displacement of the moving grid is modified to maintain the point of firing of the charge at a predetermined position of the path, by the steps of substantially continuously determining the position of the point of rise in the temperature of the gas passed through a selected element of the charge in respect of the path, generating a control signal whose instantaneous value is representative of the position of the point of firing of the charge in respect of the path, and modifying the velocity of displacement of the grid until the value of the control signal is equal to a constant value corresponding to the predetermined position of the point of firing. The value of the control signal is calculated in accordance with the equation $$L_p = L_a + kv$$

wherein $L_p$ is the instantaneous value of the control signal, $L_a$ is the position of the point of rise in the temperature of the gas, V is the velocity of displacement of the moving grid, and $k$ is a constant.

In an installation for the agglomeration of a particulate mineral charge, which comprises a moving elongate grid supporting the charge during agglomeration, a succession of suction boxes disposed along and below the elongate grid to pass a hot gas through the charge during agglomeration, and a succession of temperature measuring devices disposed below the charge to measure the temperature of the gas passed therethrough, the present invention provides sampling means for determining successively for each element of the charge passing over the temperature measuring devices the position of the point of rise in the temperature of the gas passed through the respective element in respect of the path through which the grid moves, calculating means for determining the position of the point of firing of the successive elements of the charge as a function of the value of a signal generated by the sampling means, and control means operated by the calculating means for determining the position of the point of firing and for modifying the velocity of displacement of the moving grid until the point of firing is maintained at a predetermined position. The testing means are mounted above the temperature measuring devices and the instantaneous value of the control signal changes with the position of the point of rise in the temperature in respect of the path.

As will be understood, this invention comprises the use as well as the criterion of control of the displacement speed of the grid of a guiding parameter representative of the effective position of the point of firing of the charge along the path of the moving grid.

The instantaneous value of this guiding or control parameter may be worked out on the basis of an algorithm comprising parameters whose value may be determined during the actual operating time. The instantaneous values of these parameters are relative to the same element or length of the charge as it moves on the grid along the treatment path, which eliminates errors resulting from distortions in the temperature curve mentioned hereinabove. Furthermore, the algorithm is of such a form that the guiding or control parameter corresponds to the actual displacement of the firing point transversely of the charge during the agglomeration process, as it may be observed experimentally, for example, on a stationary element or length of the charge. Finally, the point of rise of the temperature of the gas passed through the charge, which in practice corresponds to the end point of the rectilinear portion of the temperature curve, may be determined without ambiguity, which is not the case for the determination of the maximum in such a temperature curve, as outlined hereinbefore.

The correction signal may be utilized directly to modify the velocity of displacement of the grid moving through the treatment path, this signal being obtained by comparing the guiding or control parameter to a predetermined parameter representative of the desired position of the point of firing of the charge in respect of the path. Nevertheless, it is advantageous to insert into the control circuit means permitting to take into account characteristics of response of the agglomeration installation to any modification of the grid speed. This improves the stability of the control.

The above and other objects, advantages and features of the present invention will become more apparent from the following detailed description of certain now preferred embodiments thereof, taken in conjunction with the accompanying drawing wherein FIG. 1 diagrammatically illustrates an installation of agglomeration with a moving grid and including a control in accordance with one embodiment of this invention;

Figure 1:
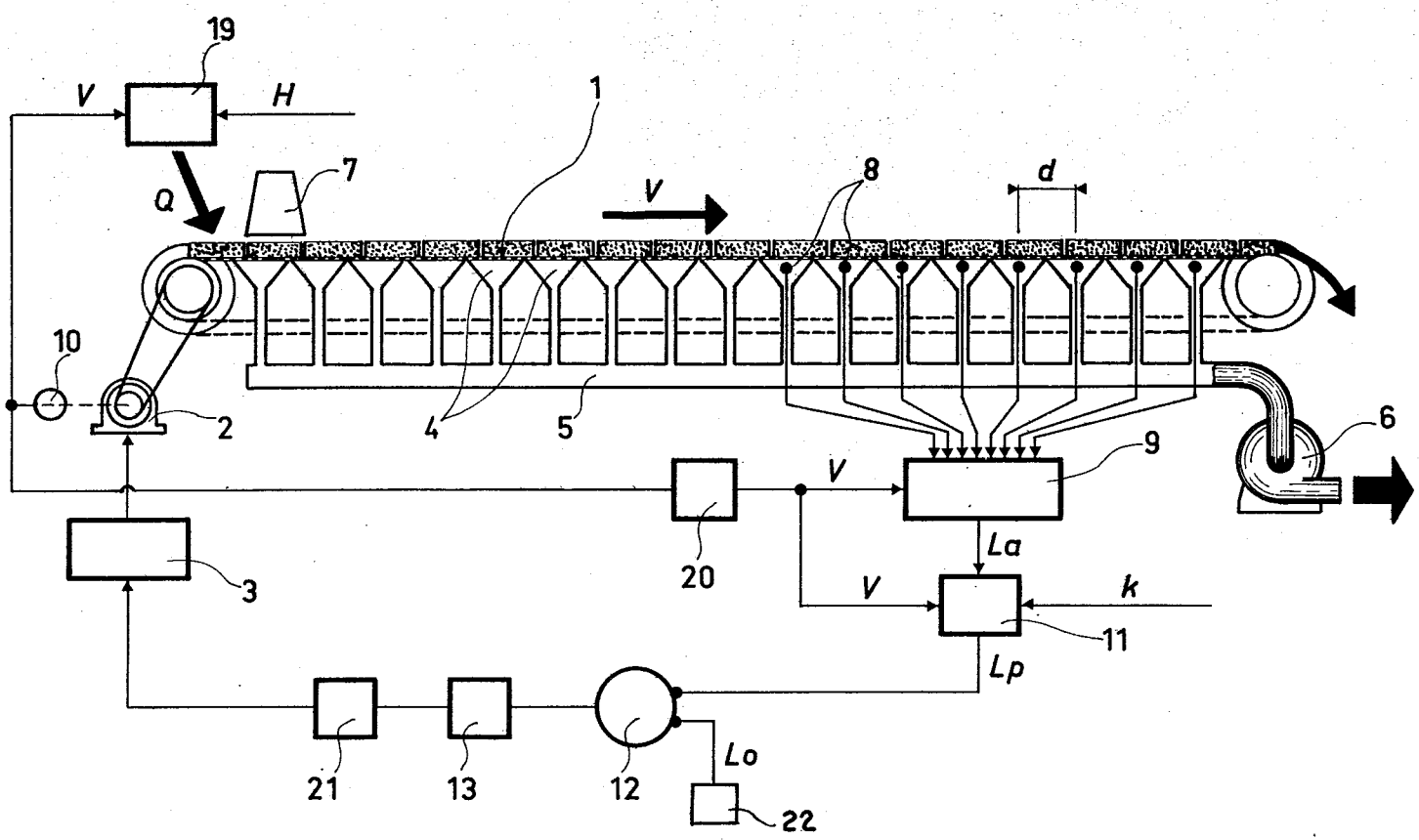

Referring now to the drawing and first to FIG. 1, there is shown an installation for the agglomeration of a particulate mineral charge on endless grid 1 moving through a treatment path in the direction of arrow V at a velocity of displacement V, the movement of the endless grid being actuated by variable-speed electric motor 2 which is continuously supplied with electric current during the operation of the installation. The speed of the motor and the corresponding velocity of displacement of the endless grid may be controlled by a conventional control element or governor 3 which varies the voltage supplied to the motor in response to the value of a control signal applied to the governor.

A succession of suction boxes 4 are disposed along and below elongate moving grid 1, the boxes being in communication with a common main 5 connected to the input of fan 6 to pass gas in the form of the ambient air through the charge supported on the moving grid. Ignition hood 7 comprising a bank of burners is disposed above the moving grid in the neighborhood of the upstream end thereof. A charge of particulate ore admixed with a solid combustible material is placed upon the upstream end of the moving grid upstream of the ignition hood in a layer of constant thickness. Any suitable means, such as an endless conveyor (not shown) may be used for loading the charge on the moving grid. The charge is constituted by a humid mixture of mineral, a solid combustible material, most often coal, and fines. As the grid moves pass ignition hood 7, successive elements or lengths of the charge are superficially ignited in an instant to by the burners in the hood and the resultant combustion is maintained by the air sucked through the moving charge and the grid by fan 6. The "front of the flame," which designates the plane of separation between the part of the charge which has been combusted and the remainder of the charge, thus gradually and progressively approaches the grid until it reaches or contacts it at the point of firing. The agglomerated or sintered charge is removed from the grid at the downstream or discharge end of the grid path.

In practice, it is found desirable to position the point of firing of the charge so that the entire cross section of the charge has been subjected to the agglomeration treatment before the charge is removed from the grid.

Furthermore, this point of firing is desirably as close as possible to the discharge end of the treatment path so as to utilize the capacity of the installation to greatest advantage and to avoid phenomena of instability which are observed when the point of firing is situated too far removed from the discharge end in the direction of movement of the grid.

With a view to detecting the position of the point of firing along the treatment path, a plurality of temperature measuring devices 8 constituted, for instance, by thermocouples are disposed below the charge to measure the temperature of the gas passed therethrough. In the illustrated embodiment, the thermocouples are mounted under the moving grid along about the last third of the treatment path.

The signals representative of the temperature values detected continuously by the thermocouples 8 are fed to programmed computer 9 which also receives signal V representative of the instantaneous velocity of displacement of grid 1. Signal V may be generated, for example, by tachometer 10 which is connected to motor 2 which entrains the grid. The computer is so programmed that it permits periodic samplings determined by all the temperature measurements delivered by devices 8, the particular values resulting from successive samplings being stored in the computer memory for a purpose to be explained hereinafter.

To understand the process of sampling, suppose the thermocouples 8 are positioned equidistantly along the treatment path under the moving grid, the distance between the thermocouples being designated $d$. The sampling is then effected with a periodicity $t$, such that $t = d/V$. The value of $d$ is fed to the computer in the form of a signal of constant value. It will thus be understood that elements or lengths of the charge disposed above the thermocouples will be displaced substantially by a distance $d$ between two successive samplings effected by computer 9, this distance coming the closer to $d$ the less the velocity of the grid displacement varies between the two samplings. In practical operations, the grid displacement velocity is of the order of 3 to 4 meters per minute so that it is easy to obtain successive measurements corresponding practically to the same element or length of the charge. This sampling results in values memorized in the computer which permit constituting successive groups of values representative of the evolution of the temperatures relative to the same element of the charge. The groups of values may be traced to produce curves of the temperature relative to successive elements or portions of the charge spaced by distance $d$ as they are displaced on the grid along the path of treatment. The successive curves are obtained with the periodicity $t$.

Figure 3:
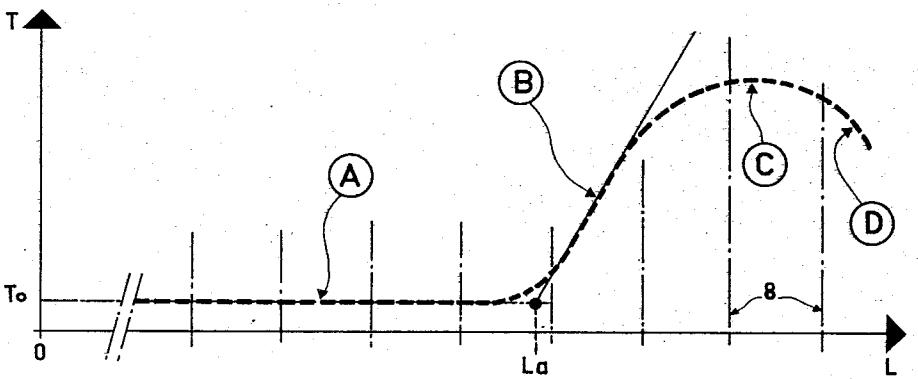
FIG. 3 shows a temperature curve relative to an element or length of the charge subjected to agglomeration treatment.

FIG. 3 represents one of the temperature curves obtained in this manner, it being understood that the tracing of these curves is not required for the practice of the present invention.

A sampling process substantially analogous to this has been described in U.S. Pat. No. 3,779,077, dated Dec. 18, 1973. It is understood that the computer may also be programmed so that it takes into account variable spacings between some or all of the temperature measuring devices.

Referring now to FIG. 3, which represents the tracing of a temperature curve related to the same element or portion of the charge passing through the treatment path on the moving grid, the curve is shown to start with a substantially rectilinear, horizontal portion A corresponding to constant temperatures, followed by a rising curve portion B corresponding to constantly rising temperatures, A maximum stage C and A final drop D in temperature. This temperature evolution may be interpreted as a function of the development of the firing process of the element of the charge under consideration. The rectilinear curve portion A corresponds to the presence of an initially humid layer of the charge on the grid and represents a relatively low temperature $t_o$. In fact, this humid layer remains on the grid for the major portion of the treatment path and, for this reason, it is not necessary to place temperature measuring devices under the grid in this relatively cold zone of the treatment path. The ascending leg B of the temperature curve corresponds substantially to the drying out of the humid layer in contact with the grid, the temperature rising rapidly in this zone until it reaches the point of combustion of the combustible material, for instance coal, i.e. until the front of the flame reaches this layer. The rapidly rising curve portion B then progressively passes into the stage C in which the maximum must be detected, which corresponds to the firing point, i.e. when the layer of combustion or the front of the flame reaches the grid. However, the gradualness of this phenomenon as well as the effects of thermal inertia make it practically impossible to locate the maximum or, at least, to localize the maximum on this stage of the temperature curve with any certainty in respect of the actual point of firing. Thus, one may consider stage C of the curve simply to constitute a plateau of elevated temperature remaining substantially constant over a zone wherein the point of firing is necessarily situated. The curve portion D corresponds to progressively cooler temperatures of the layer in contact with the grid. It is thus apparent that it is not possible to effectuate a direct determination on the temperature curve of the exact position of the point of firing in respect of the treatment path.

We have attempted to obviate this difficulty by considering the effective process of the displacement of the front of the flame transversely through the charge. With this in mind, we recorded the temperatures in a transverse direction of the thickness of the layer of the same element or portion of the charge in the course of agglomeration. This may be done directly on the moving grill of an agglomeration installation, as this element of the charge passes through the treatment path, or it may be done on a fixed grid of an experimental installation model, the charge mixture on the model installation having, of course, the same properties as the charge on the moving grill of an actual installation. Thus, the different temperature stages described hereinabove in connection with FIG. 3 are found in a similar form across the thickness of the layer of the charge element under consideration.

Figure 4:
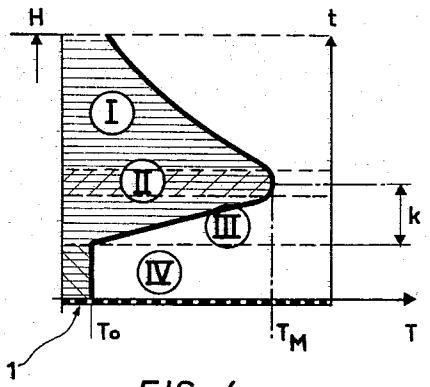
FIG. 4 shows a curve relative to the temperature profile along the height or thickness of an element of the charge.

As will be noted from the graph of FIG. 4, each element of the charge under consideration may, in effect, be divided into four superposed zones I to IV, upper zone I corresponding to the agglomerated material, adjacent zone II corresponding to the front of the flame or point of firing, following zone III corresponding to a dry layer of the charge mixture, and lowest zone IV corresponding to a humid charge layer. It is apparent that the phenomena of thermal inertia discussed in connection with the tracing of the curve of FIG. 3 have been eliminated. The position of the front of the flame or point of firing is thus accurately characterized by a maximum $T_m$ on the curve reflective of the evolution of the temperatures across the thickness of the element of the charge under consideration.

In the graph of FIG. 4, the recorded temperatures are entered along the abscissa and the points of the measurement of the temperature across the thickness of the element of the charge have been entered along the ordinate. We have observed experimentally and in a reproducible fashion that the distance between the level corresponding to the beginning of the rise in temperature and the level corresponding to the maximum temperature or, in other words, the distance between the upper part of the humid zone adjacent to the drying zone and the front of the flame has a constant value for the same charge mixture treated on a given installation, and this value remains constant for a wide range of variations in the operating conditions of the installation. The value of this constant will change only if the operating parameters are significantly changed, for instance by modifying the conditions of the aspiration of air across the charge, or by changing the nature of the composition of the charge, or by changing the installation. For each of these changed conditions, however, the constant may be predetermined.

Figure 5:
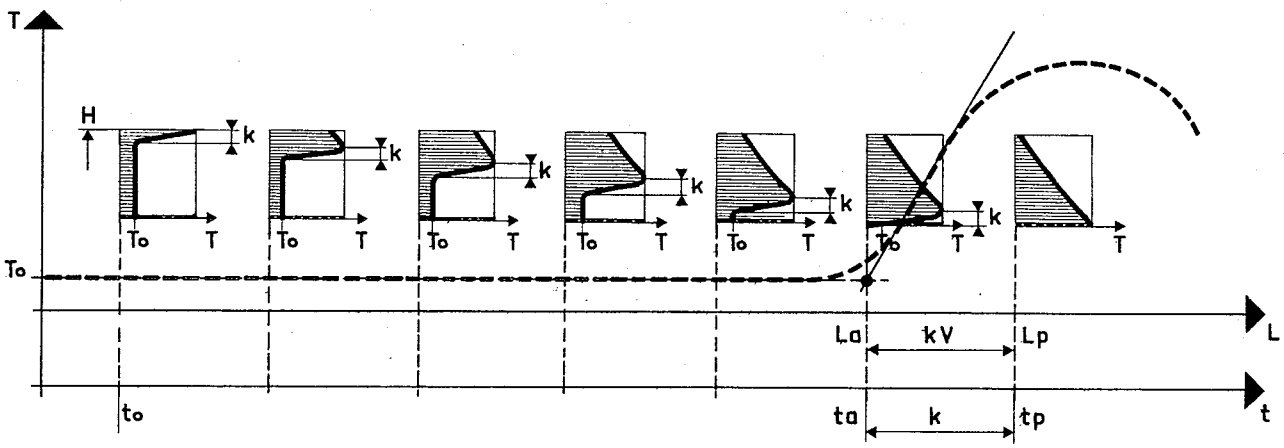
FIG. 5 is a schematic illustration of the determination of the point of firing of an element of the charge at one stage of the process according to the invention.

This experimental observation has led us to conclude that the time needed for the front of the flame to reach the level within the charge where, at the same instant, the humid zone is separated from the dry zone is also constant. The value of this time is constant $k$ for a given charge mixture and given conditions of gas aspiration through the charge. The graph of FIG. 5 shows the curve of temperatures recorded for an element or portion of the charge by computer 9, the respective curves of the temperature profiles recorded along the thickness of this charge element being superimposed on the graph, it being understood that this represents only an illustrative example of the invention.

If $L_a$ is the position of the point of rise in the temperature of the gas passed through the charge transversely thereacross, which corresponds to the distance separating the point of superficial ignition of the element of the charge from the point wherein the dry zone of the element reaches the grid, $L_p$ is the distance separating the ignition point from the point of firing, and V is the velocity of displacement of the grid along the path of treatment, $$L_p = L_a + kV$$

In effect, from the moment at which the dry zone reaches the grid, the front of the flame requires a constant time $t = k$ to reach the grid in an instant $t_b$ so that the distance $L_p - L_a$ travelled during this time by the element of the charge has the value $x = kV$. This gives the above equation.

The curve of the temperatures detected by temperature measuring devices 8 makes it possible to determine without ambiguity a point corresponding to the beginning of the rise in the temperature of the gases sucked through the successive element or portions of the charge. In other words, it is possible to determine the position of the path through which the grid moves where the dry zone of the successive elements of the charge reaches the grid by periodically sampling the temperatures. Thus, the value of $L_a$ may be substantially continuously determined, and the effective position of the point of firing of the successive elements of the charge may be determined as a function of the actual behavior of the charge at that time.

The determination of the point corresponding to the beginning of the rise in the temperature of the gas fumes is effectuated by computer 9 on the basis of successive groups of values of temperatures obtaining by sampling. Various methods may be used to make this determination. By way of example, computer 9 may be programmed so that it determines the point of intersection between a straight line corresponding to the average temperature of relatively cool fumes and the tangent to the turning point of the ascending part of the temperature curve.

Referring back to FIG. 1, there is shown calculating element 11 connected to the output of programmed computer 9, the calculating element generating numerical control signal $L_p$ which is a function of the output signal of value $L_a$ produced by computer 9, of the signal of the value V and of the signal representative of predetermined value $k$ set by the operator on the basis of the nature of the charge and the specific installation, all three signals being fed to calculating element 11 to produce numerical control signal $L_p = L_a + kV$.

In the embodiment shown in FIG. 1, output signal $L_p$ of calculating element 11 is fed to a first input of a numerical comparison element 12, a second input of the comparison element receiving a numerical signal of reference of predetermined value $L_o$ generated by an indicator 22, this value corresponding to the desired position of the point of firing in the treatment path. The comparison element generates at its output a numerical signal of correction which is applied to the input of a conventional regulator 13 with proportional, integrated and differential action. The output signal of regulator 13 is applied to the input of control unit 3 which regulates the speed of rotation of motor 2 entraining moving grid 1 at controlled velocities of displacement. All the operations of computer 9, calculating element 11, comparison element 12 and regulator 13 are effectuated by numerical signals. Therefore, the output signal of tachometer 10 is converted into numerical form by an analog converter 20 to feed numerical velocity signal V to element 11 and a numeric-analog conversion is effected by converter 21 interposed between regulator 13 and control 3.

This produces a control circuit which permits the velocity of the displacement of the moving grid to be modified in response to the value of control signal $L_p$ which represents the position of the point of firing in respect of the treatment path. This control permits this control value to be maintained substantially equal to the predetermined value $L_o$.

The thickness of the charge supported on the moving grid is maintaned constant by applying to the input of a control device 19 a signal representative of the instantaneous value of the velocity V and a constant H corresponding to a desired value of the thickness of the charge. Control device 19 generates an output signal Q corresponding to the instantaneous flow of the components of the charge mixture loaded at the upstream end of the treatment path on the moving grid, which permits the thickness of the charge to be held constant.

It is understood that the installation may comprise conventional means for maintaining the composition of the charge substantially constant.

The installation illustrated in FIG. 1 operates in the following manner:

Successive elements or portions of lengths of a mineral charge of a given thickness are loaded at the upstream end on elongate grid 1 moving through a treatment path to a downstream end from which the agglomerated elements of the charge are removed. Gas is passed through the charge during agglomeration by means of a succession of suction boxes 4 disposed along and below the elongate grid. The temperature of the gas passed through the charged is measured along about the last third of the path by a succession of thermocouples 8 disposed below the charge. The velocity V of the displacement of grid 1 is modified to maintain the point of firing of the charge at a predetermined position of the path.

This is done by substantially continuously determining the position of the point of rise in the temperature of the gas passed through the same element of the charge in respect of the path by computer sampling means 9 which generates signal $L_a$ whose instantaneous value changes with the position of the point of rise in temperature in respect of the path. Calculating means 11 generates control signal $L_p$ whose instantaneous value is representative of the position of the point of firing of the charge in respect of the path, this position is a function of the value of signal $L_a$ and signals V and k fed into the calculating element 11 on the basis of equation $L_p = L_a + kV$. Control 3 is operated by calculating element 11 for determining the position of the point of firing and modifies the velocity of displacement of the grid until the value of the control signal $L_p$ is equal to a constant value $L_o$ corresponding to the predetermined position of the point of firing.

The value of control signal $L_p$ is compared with the value of signal $L_o$ in comparison element 12 to generate a correction signal and the velocity of displacement of grid 1 is modified until the value of the correction signal generated by element 12 is zero. For this purpose, a first input of comparison element 12 is connected to the output of calculating element 11, a second input of the comparison element is connected to indicator 22 delivering reference signal $L_o$, and the output of the comparison element is connected to control 3 for modifying the velocity of displacement of moving grid 1.

Figure 2:
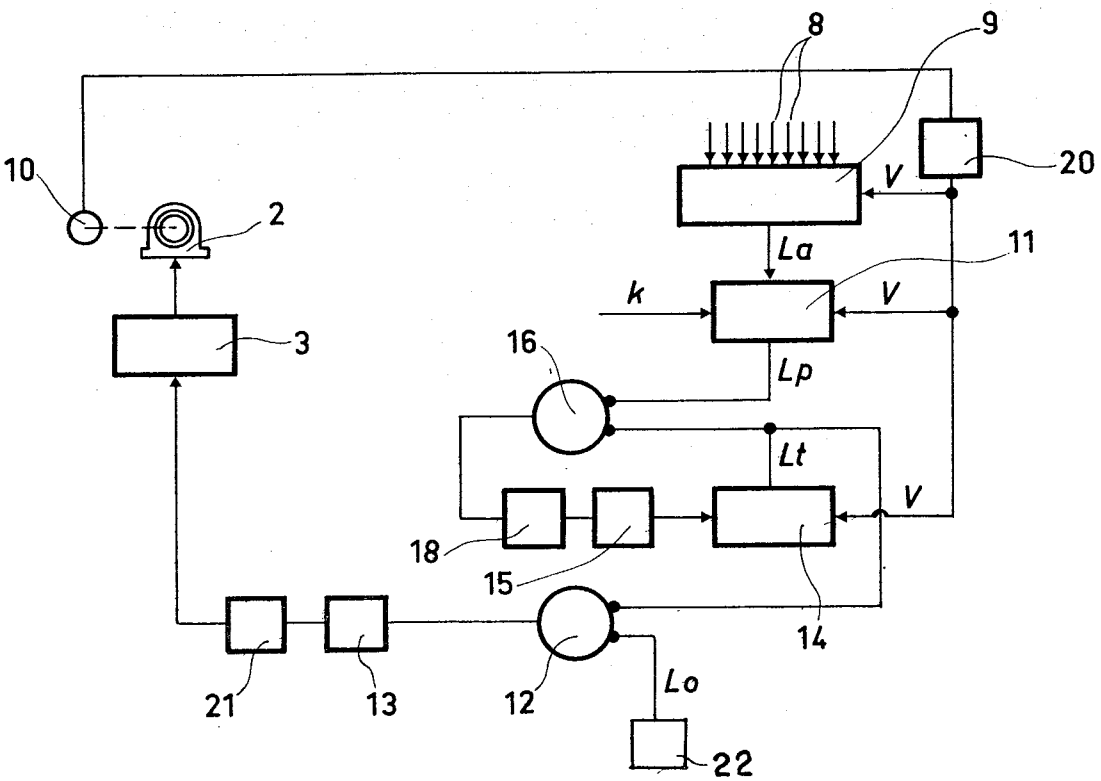
FIG. 2 is a diagram of another embodiment of the control.

FIG. 2 shows a modified control taking into account specific characteristics of the response of specific agglomeration installations. In this embodiment of the present invention, the control means for modifying the velocity of the displacement of the moving grid comprises a model of the installation constituted by electric circuit 14 whose transfer function is substantially identical to or representative of the transfer function of the agglomeration installation. This transfer function of circuit 14 comprises a gain factor whose value may be adjusted by gain control element 15 to produce an adaptive model of the installation. To avoid redundancy in the description, all like elements are designated by like reference numerals and function in a like manner in the embodiments of FIGS. 1 and 2.

Circuit 14 is connected between the output of calculating element 11 and the first input of comparison element 12. The circuit may be of the two-terminal network type with a transfer constant or function F(p), receiving signal V representative of the grid displacement velocity at one input and generating at its output signal $L_t$ represenative of a theoretical position of the point of firing and calculated in accordance with the equation $$L_t = F(p) \cdot V$$

wherein F(*p*) is representative of the response of the agglomeration installation to a modification of the velocity of the moving grid.

The transfer constant or function of a system, in this instance an agglomeration installation, is conventionally determined by studying the response of the system to a sudden variation of an input variable, in this case the velocity of displacement of the grid. We have observed herein a transfer function of the second order of the type $$F(p) = G/(1+\zeta p)^2$$

wherein G is the gain, $\zeta$ is a time constant, and $p$ is Laplace's operator which satisfactorily represents the response of an agglomeration installation to a modification of the velocity of displacement of the moving grid to obtain a desired position of the point of firing. At any given moment for which the gain and grid speed have particular instantaneous values, it is thus possible to calculate the particular value corresponding to the theoretical position of the point of firing according to the equation $$L_t = A \cdot G$$

wherein A is a quantity which may be determined in each instant.

In the embodiment of FIG. 2, there is provided a further comparison element 16 connected between the output of calculating element 11 and an input of electric circuit 14. A first input of comparison element 16 receives control signal $L_p$ generated by calculating element 11 and a second input of the comparison element 11 receives output signal $L_t$ of electric circuit 14. In this manner, the value of signal $L_t$ is compared with the value of signal $L_p$ corresponding to the actual position of the point of firing of the charge to generate an error signal. This numerical error signal at the output of comparison element 16 is fed to the input of gain control element 15 which is connected to the output of comparison element 16, element 15 generating a correction signal for modifying the transfer function of electric circuit 14 on the basis of the signal generated by comparison element 11 until the value of the error signal is zero. In this manner, the model of the installation is substantially continuously adapted to the actual behavior of the installation in operation. The adapted value of signal $L_t$ is then fed to the first input of comparison element 12, instead of signal $L_p$, as in the embodiment of FIG. 1. Otherwise, the two embodiments operate in the same manner.

Preferably, as shown in FIG. 2, smoothing filter 18 is interposed between the output of further comparison element 16 and the input of gain control element 15 for modifying the gain on the basis of a predetermined criterion of significance whereby significant variations in the value of the error signal coming from comparison element 16 are detected on the basis of this criterion. In this manner, the transfer function of circuit 14 is modified until the significant variations have been eliminated.

The operation of smoothing filter 18 corresponds to that of a so-called quadratic minimization which will be described hereinafter. If $\epsilon$ is the value of the error signal generated by further comparison element 16, the smoothing filter has the function of minimizing at each instant the value of the quantity $$W = \sum_{i-n}^{i} \epsilon^2$$

wherein $\epsilon(i)$ is the value of the error signal at the instant considered and $\epsilon(i-n)$ is the value of the error signal for an instant removed from instant $i$ by $n$ sampling operations.

If B is the particular value of signal $L_p$ at any instant $i$, the value of error signal $\epsilon(i)$ at that instant $i$ is $$\epsilon(i) = L_t - L_p = AG - B$$

Thus, the quantity W has the following value:

$$W = \sum_{i-n}^{i} (AG - B)^2 = \sum_{i-n}^{i} (A^2G^2 - 2ABG + B^2)$$

This quantity has a minimal value for $$G = \sum_{i-n}^{i} AB \Big/ \sum_{i-n}^{i} B^2$$

wherein the particular values of A and B at the instant under consideration are known.

Thus, the smoothing filter will at each instant calculate a value of gain corresponding to the operation of the quadratic minimization set forth hereinabove. This value is applied to gain control element 15 to modify the transfer constant of circuit 14. The choice of the number n of the summations is made by a compromise which takes into account that too small a number chosen will make the smoothing effect insufficient while too high a number results in the control system reacting relatively slowly to the appearance of a disturbance in the desired operation of the installation. In practice, satisfactory control has been obtained with a number of summations corresponding to a time interval practically equal to the time of response of the installation.

With the smoothing filter in the control circuit, accidental fluctuations in value $\epsilon$ of the error signal will not directly modify the gain of the model circuit 14. In other words, only significant variations in value $\epsilon$ will be taken into account in the control.

We have found that the practice of this invention substantially reduces fluctuations in the position of the point of firing in respect of the treatment path through which the elongate grid of an agglomeration or sintering installation moves. For instance, we have found that in 95% of the cases, the point of firing varied by the order of ±4 meters from the average desired position in an uncontrolled installation of agglomeration with a grid moving through a treatment path of 56 meters at a velocity of three meters per minute. The operation of this installation was then controlled by disposing thermocouples 8 below the moving grid at a distance of 50 cm from each other, which permitted the value representative of the actual point of firing to be obtained every 10 seconds. Thus, a correction signal for modifying the velocity of displacement of grid 1 could be generated every 10 seconds. This enabled the fluctuations of the position of the point of firing to be reduced with the same degree of probability to ±1.5 meters, using the control system of FIG. 2. While this reduction in the amplitude of fluctuations of the position of the point of firing in respect of the treatment path is due essentially to the determination of the actual position of the firing point obtainable by the system of FIG. 1, the adaptive model inserted in the embodiment of FIG. 2 permits an even better use of this control system in specific cases.

What is claimed is:

1. In a method of operating an installation for the agglomeration of a particulate mineral charge on an elongate grid moving through a treatment path, wherein a gas is passed through the charge during the agglomeration, the temperature of the gas passed through the charge is measured along the path, and the velocity of displacement of the grid is modified to maintain the point of firing of the charge at a predetermined position of the path: the steps of (1) substantially continuously determining the position of the point of rise in the temperature of the gas passed through an element of the charge in respect of the path, (2) generating a control signal whose instantaneous value is representative of the position of the point of firing of the charge in respect of the path, (a) the value of the signal being calculated in accordance with the equation $$L_p = L_a + kV$$

wherein $L_p$ is the instantaneous value of the control signal, $L_a$ is the position of the point of rise in the temperature of the gas, V is the velocity of displacement of the moving grid, and $k$ is a constant, and (3) modifying the velocity of displacement of the grid until the value of the control signal is equal to a constant value corresponding to the predetermined position of the point of firing.

2. In the operating method of claim 1, the step of comparing the value of the control signal with the value of the signal corresponding to the predetermined position to generate a correction signal, the velocity of displacement of the grid being modified until the value of the correction signal is zero.

3. In the operating method of claim 1, the steps of generating a signal of value $L_t$ representative of a theoretical position of the point of firing and calculated in accordance with the equation $L_t = F(p) \cdot V$, wherein $F(p)$ is a transfer function representative of the response of the agglomeration installation to a modification of the velocity of the moving grid, comparing the value of signal $L_t$ with the value of the signal corresponding to the position of the point of firing of the charge to generate an error signal, modifying the transfer function until the value of the error signal is zero, and comparing the value of the signal representative of the theoretical position of the point of firing with the value of the signal corresponding to the predetermined position of the point of firing of the charge to generate a correction signal, the velocity of displacement of the moving grid being modified until the value of the correction signal is zero.

4. In the operating method of claim 1, the steps of generating a signal of value $L_t$ representative of a theoretical position of the point of firing and calculated in accordance with the equation $L_t = F(p) \cdot V$, wherein $F(p)$ is a transfer function representative of the response of the agglomeration installation to a modification of the velocity of the mobile grid, comparing the value of signal $L_t$ with the value of the signal corresponding to the position of the point of firing of the charge to generate an error signal, detecting significant variations in the value of the error signal on the basis of a predetermined criterion of significance, modifying the transfer function until the significant variations have been eliminated, and comparing the value of the signal representative of the theoretical position of the point of firing with the value of the signal corresponding to the predetermined position of the point of firing of the charge to generate a correction signal, the velocity of displacement of the moving grid being modified until the value of the correction signal is zero.

* * * * *